United States Patent [19]

Bergmann et al.

[11] Patent Number: 4,495,029

[45] Date of Patent: Jan. 22, 1985

[54] PROCESS FOR THE PREPARATION OF COATED PAPER AND CARDBOARD AND COATING MATERIALS FOR THE PERFORMANCE OF THE PROCESS

[75] Inventors: Kurt W. Bergmann, Brüggen; Popko J. Westerhuis, Hückelhoven-Baal, both of Fed. Rep. of Germany

[73] Assignee: Feldmühle Aktiengesellschaft, Düsseldorf, Fed. Rep. of Germany

[21] Appl. No.: 409,361

[22] Filed: Aug. 19, 1982

Related U.S. Application Data

[63] Continuation of Ser. No. 131,860, Mar. 19, 1980, abandoned.

[30] Foreign Application Priority Data

Mar. 24, 1979 [DE] Fed. Rep. of Germany ..... 2911679

[51] Int. Cl.[3] ..... D21F 11/00

[52] U.S. Cl. ..... 162/135; 162/158; 162/168.1; 162/184; 427/326; 427/391

[58] Field of Search ..... 162/135, 184, 181.1, 162/181.4, 181.6, 181.8, 158, 168.1; 106/288 B, 288 Q, 308 N, 308 M; 427/326, 385 R, 395, 341, 342, 391

[56] References Cited

U.S. PATENT DOCUMENTS

| | | | |
|---|---|---|---|
| 3,578,493 | 5/1971 | Smith | 427/395 |
| 4,226,749 | 10/1980 | Veante | 260/17.2 |

FOREIGN PATENT DOCUMENTS

| | | | |
|---|---|---|---|
| 741224 | 8/1966 | Canada | 427/395 |
| 1696171 | 11/1971 | Fed. Rep. of Germany . | |
| 7025328 | 8/1970 | Japan | 427/326 |
| 1021887 | 3/1966 | United Kingdom . | |

*Primary Examiner*—Peter Chin

*Attorney, Agent, or Firm*—Toren, McGeady and Stanger

[57] ABSTRACT

A method for the coating of a raw paper or cardboard substrate wherein the substrate is prepared having a pH of less than about 6.5, and a coating is applied thereto composed of an aqueous dispersion of a plastic and an inorganic pigment, the coating having a pH of more than about 6.5 wherein the particles of the plastic in the dispersion have a non-cation-active charge and wherein the coating also contains a material which does not affect the preparation or storage stability of the coating, but which in the pH range below about 6.5 becomes highly cation-active, and then drying the thus applied coating. Using this method, the coating solidifies at the time of contact of the coating and the paper surface thereby minimizing penetration of the coating into the paper. As a result, improved coated papers are obtained.

15 Claims, 3 Drawing Figures

PROCESS FOR THE PREPARATION OF COATED PAPER AND CARDBOARD AND COATING MATERIALS FOR THE PERFORMANCE OF THE PROCESS

This is a continuation of application Ser. No. 131,860 filed Mar. 19, 1980, now abandoned.

BACKGROUND OF THE INVENTION

1. Field of the Invention

The present invention relates to a process for the preparation of coated paper and cardboard in which a coating material composed of particles of an aqueous dispersion of plastic and inorganic pigment particles is applied to and dried on the raw paper or cardboard for coating.

2. Description of the Prior Art

The requirements for the increasing high quality demanded of printing papers conflicts with the continuous demands to decrease costs. The solution of this problem is especially urgent in the so-called LWC (lightweight coated) papers which are used for mail order catalogues, illustrated magazines, etc. The possibilities to achieve a decrease in cost by using less expensive raw materials without, at the same time, decreasing the quality have for the most part been exhausted. Today, LWC papers are produced with an extremely low weight per unit area to minimize costs.

The raw papers for coating have a weight between 36 and 40 g/m$^2$, and the amount of coating used is between 8 to 12 g/m$^2$ per side. These weights represent a technological limit below which one cannot go even with the greatest efforts. Moreover, work in these boundary areas leads to enormous difficulties during the coating process.

Thus, low weight per unit area often leads to "penetration" of the coating material, i.e., the coating material penetrates the substrate and builds up on the coating cylinder. This results in defects in the coating and, if there are heavier deposits, the paper tears. Then the coating device has to be stopped and cleaned. The downtime periods lead to increased production costs.

The penetration of the coating material into the paper has still another disadvantage. The coating material which penetrates into the paper does not contribute to the improvement in quality of the paper surface. Therefore, it is generally desirable that only that amount of coating material penetrate into the substrate which is needed to effect the bonding of the surface coating. However, the larger portion should remain on the surface to improve the printing capability. For this reason, coating materials which penetrate too deeply into those types of paper and cardboard with higher weight per unit area are also undesirable even though such penetration may not interfere with processing.

In the past, efforts to prevent excessive penetration of the coating material and especially penetration of the coating material in LWC papers have been made. Generally, there have been attempts to influence the penetrating behavior of the coating materials by increasing the solids content or the viscosity. However, these have not led to satisfactory results. The increase in the solids content in a coating material is limited by the water requirements needed for dispersion of the pigments used. Usually, coating materials with a solids content of more than 60% cannot be manufactured or at least cannot be used under conditions of actual practice.

However, penetration of coating materials which have an even higher solids content can only be prevented to a limited extent.

An additional difficulty in LWC papers is that weights of the applied coating in the area of interest, i.e., below 12 g/m$^2$, are difficult to achieve with coating materials having a solids content of more than 60%. Coating materials with only an increased viscosity also show no decreased penetration behavior. The addition of electrolytes and cationic substances to the coating material has been suggested, but usually such addition unfavorably affects the rheology of the coating material so that this modification has not been accepted in practice.

SUMMARY OF THE INVENTION

Figure 1:
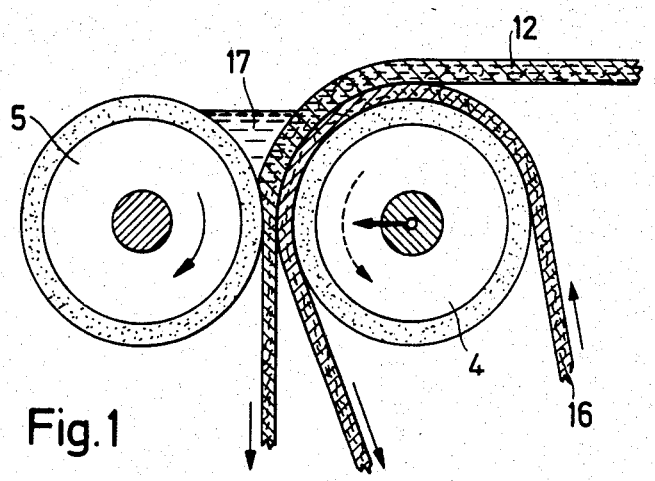
FIGS. 1 and 2 show schematic side views of a testing device.

We have discovered a method to eliminate these known difficulties and have created a process for the preparation of coated paper and cardboard in which the coating material only penetrates into the substrate to a limited extent. This process is especially suitable for preventing the penetration of the coating material with LWC papers.

Additionally, with the present invention, LWC papers with reduced weight per unit area can be produced with savings in both valuable raw materials and energy usage.

Furthermore, the coating material of the present invention can be prepared using the usual color components, and especially the usual plastic dispersion and pigments, and with the usual apparatus.

More particularly, the method of the present invention comprises preparing a raw paper substrate having a pH of less than about 6.5, applying a coating thereto composed of an aqueous dispersion of a plastic and inorganic pigments, the coating having a pH of more than about 6.5 wherein the particles have a non-cation active charge and wherein the coating also contains a material which does not effect the preparation or storage stability of the coating, but which in the pH range below about 6.5, becomes high cation-active, and then drying the thus applied coating.

As a result of this method during contact of the paper (or cardboard) and the coating, the coating material at the boundary surface of the paper (or cardboard) solidifies.

DESCRIPTION OF THE PREFERRED EMBODIMENT

In order to successfully carry out the process of the present invention, it is important that all process conditions be met. The use of raw paper or cardboard with a pH-value below 6.5 and the adjustment of the coating materials to a pH-value above 6.5 make it possible to work within the pH-range of the usual coating material. As a result, the substance added to the coating material becomes more cation-active only at the contact of the coating material with the substrate. The selection and the possibilities of application of the substances that become more strongly cationic and the plastic dispersion are to be carefully adjusted to each other. Plastic dispersions suitable for use in the present invention include those used which, so far, were conventionally used for the preparation of coating materials, such as, butadiene styrene copolymers, acrylic acid ester copolymers, with, for instance, polyvinylacetate and the like, as long as the plastic particles do not have a cation-active charge condition.

The expression plastic particle with a non-cation-active charge as used herein means those plastics which have an anion-active emulsifier system or are stabilized in a non-ionic manner. Many plastic dispersions with emulsifier systems that consist of anionic as well as non-ionic substances can also be included. Additionally, dispersions in which the ionogenic charge condition is determined by the specific groups attached to the polymer itself may be used.

However, plastic dispersions with particles that carry a cation-active charge are not suitable for the purpose of the present invention. Also not suitable are those which, when added to a coating material, have their stability influenced by a weakly cation-active substance so that problem-free preparation, storage and handling of the coating material is no longer possible. The effect on the degree of stabilization does not necessarily manifest itself in coagulation of the coating materials. Rather, the effect is often already noticeable by an increase in viscosity above the normal level.

Additionally unsuitable are those plastic dispersions which have such a high degree of stabilization that, when a weakly cation-active substance is added to the coating materials and under the influence of an acidic surface on the paper, their degree of stabilization is not at all or only slightly affected so that the desired solidification of the coating materials at the contact points between the coating and paper does not occur.

The substances which are added to the coating material and which become strongly cation-active only in a pH-range below 6.5, generally also possess a weakly cation-active character even at high pH-values and are identified herein as weakly cationic substances. However, the cationic effect which they exert is so small that it does not significantly influence the stability of the coating material. They exert their characteristic and significant action only at the acidic pH-values. Thus, during contact with an acidicly prepared paper, their cation-active effect increases and results in solidification of the coating material at those areas where contact exists between the coating material and the acidic paper.

Due to solidification of the coating material in the boundary surface areas, further penetration of the coating material into the raw paper is prevented and in LWC papers, penetration is eliminated. The coating material in accordance with the present invention thus fulfills its intended task, i.e., the improvement of the surface of the paper, much better than a coating material which has penetrated into the paper to a considerable extent.

While there is no complete explanation as to how the solidification of the coating material in the boundary areas occurs in the individual case, the mode of action can however probably be explained as follows:

The substances added to the coating material at first do not influence the stability of the coating material when it is adjusted to a pH-value of more than 6.5. Therefore, the preparation and processing of the coating material are not subject to any limitations and can be carried out in the usual manner.

However, when the coating material is applied to the surface of raw paper or cardboard having a surface with an acidic pH-value, then the substances become heavily cationic and influence the degree of stabilization of the plastic binding agent used. The reduced degree of stabilization of the plastic dispersion apparently produces complete coagulation of the coating at the boundary areas of the substrate and the coating material, since usually water separation can be observed. However, the reason could also be that the plastic dispersion in the boundary area is irreversibly converted to a gel-type condition. In any case, the reduced stability of the plastic dispersion in the boundary surface areas leads to solidification of the coating material. The solidifed coating materials acts essentially as a blocking layer, and prevents further penetration of that portion of the coating material which has not come into contact with the surface into the substrate. Consequently, this portion has an unchanged pH-value and its stability is not affected.

Raw paper or cardboard for coating with a pH-value between 4.5 and 6.0 has proven to be especially advantageous for use in the present invention. Raw paper and cardboard for coating is often manufactured in this pH-range and therefore can be used in the process according to the invention without having to resort to additional measures. There is also the special advantage that, in using such substrates, a very rapid and complete destabilization in the boundary surface areas takes place.

In an especially preferred embodiment of the process according to the present invention, raw papers and cardboards for coating are used in which the adjustment of the pH-value to a value of 4.5 to 6.2 results by adding a sulfuric acid compound of aluminum to the fiber slurry. Aluminum sulfate as well as potassium-aluminum sulfate has proven to be suitable. If an even lower adjustment of the pH-value is desired, then this is best accomplished by adding sulfuric acid.

Aqueous coating materials for paper are usually prepared and processed in the alkaline range. For the performance of the process according to the invention, the adjustment of the coating material to a pH-value between 7.5 and 11 has proven to be practical. When the coating materials have a pH-value within this range, sufficient stability during preparation and processing as well as safe solidification of the coating material in the boundary surface area is guaranteed when the coating material is applied to the substrate.

Even though plastic dispersions whose particles have a non-ionic charge condition are suitable for use in the process of the present invention, plastic dispersions in which the particles are charged anion-active have proven to be especially practical. In such dispersions, excellent destabilization is achieved due to the presence of substances which become increasingly cation-active in the acidic pH-range.

In a practical embodiment of the process of the present invention, those plastic dispersions are used in which the anion-active charge conditions of the particles is affected by the anionic groups of the plastic molecule. However, especially advantageous plastic dispersions are those in which the anion-active charge condition of the particles is based on an anion-active emulsifier-or stabilizer system.

For the effective performance of the present process, it is important that the substance added to the coating material experience an increase in its cation-active charge condition due to contact with the acidic surface of the substrate. In view of this, especially suitable substances are those which are only weakly cation-active in the coating material. Such substances can change their charge condition easily by a change in their pH-value.

The cation-active substances added to the coating material must merely possess the characteristic of becoming heavily cationic at a pH-value of less than 6.5. Amino compounds which are soluble in water and which carry two or more alkyl-, aryl- or arylkyl residues at the nitrogen atom and belong to the group of tertiary and quaternary amino compounds are especially suitable. The quaternary amino compounds are preferred.

The destabilization of the coating materials in the boundary surface area with the substrate depends on the specific type of substance which becomes heavily cation-active in a pH-range below 6.5, on the stability of the binding agent used, and on the amount of this substance added to the coating material. It is advantageous if this addition be limited to amounts which do not influence the stability of the coating material. An added amount of 2 to 20 weight percent based on solids of the plastic dispersion in the coating materials has proven to be especially practical.

A practical embodiment of the present process comprises applying a coating material with a solids content of 30 to 35 weight % with an airknife coating device on one side of a raw coating paper or cardboard in such an amount that the weight of the dried coating is 10 to 12 g/m$^2$. This demonstrates that the coating material did not penetrate deeply into the substrate and thus, a larger amount of the coating remained on the surface to contribute to an improvement in the quality of the paper.

The process according to the invention is especially suitable for the preparation of LWC papers. Use of this process prevents the undesirable penetration of the coating materials and enables the coating process to be carried out without interference. Due to the avoidance of expensive machine stoppage periods and significantly better utilization of the machines and installations which represent large investments, economic advantages result.

LWC paper prepared according to the present coating process exhibits improved printing properties with photogravure printing. The improved quality is noticeable in the heavily reduced number of missing dots (tiny unprinted areas) compared to those that occur in the usual coating processes. In many cases, the occurrence of missing dots is reduced to levels lower than those obtained with conventional processes even when the weight of the coating is reduced. This clearly indicates that the coating material penetrates less deeply into the coating paper and a much greater amount remains on the surface than with conventional processing.

An additional important advantage possible with the present invention is the reduction of the weight per unit area of the raw paper down to a weight per unit area of 32 g/m$^2$. With conventional processes, the lower limit of the weight per unit area for LWC raw papers was 36 g/m$^2$. Going below this limit led to increased occurrence of penetration of the coating material. The use of a lighter weight paper for coating is therefore of special economic interest because the paper compared to the coating material is the more expensive raw material.

Due to the present invention, it is possible to change the ratio of the weight of the raw paper to the coating beyond the conventional limits and, in turn, to better modify the products for the applicable requirements. An additional advantage is that due to the reduction of the weight of the coating, additional expenses in raw materials can be saved. Conventionally, a coating weight of 8 g/m$^2$ was considered as the lower limit. With the present invention, coating weights of 6 to 7 g/m$^2$ per side can be achieved.

To achieve these lower coating weights, the solids content of the coating material is reduced in a simple manner. Reduction of the solids content is the complete opposite of the previous suggestions for preventing penetration of the coating material which generally involved increasing the solids content. The previously mentioned lower limit of 8 g/m$^2$ for the coating weight per side was substantiated by the fact that at the high solids content and such a limited coating weight, uniform application could no longer be achieved. Further reduction of the coating weight would only be possible by having coating materials with an even more reduced solids content, which, however, would lead to penetration of the coating material. By using the process according to the present invention, and the resulting solidification of the coating material at the boundary surfaces to the raw paper for coating, it is possible to further reduce the weight of the coating and the solids content of the coating material.

In an especially advantageous embodiment for the preparation of a light weight coated paper, a coating material with a solids content of 45–62 weight % is used. This coating material is applied on a raw paper without ground wood with a weight per unit area of 32–38 g/m$^2$, preferably 34–36 g/m$^2$, with a blade coating device on both sides, whereby the weight of the dry coating is 6–7 g/m$^2$ per side.

On can also use binding agents based on starch or protein in the preparation of the coating material according to the invention. Thus, it is not necessary in every case that all binding agents used coagulate or are converted to a gel-like condition. Rather, it is usually sufficient if one of the plastic dispersions used, usually the one which is present in the coating material in the largest amount, is influenced in its stability in such a way that the maximum solidification of the coating material is affected. Also partial solidification in the boundary surface area also suffices to prevent further penetration of the coating material into the raw paper.

Especially suitable for carrying out the present process is a coating material having a pH-value of 8.1 to 10.1, a solids content of 48 to 62 weight %, and the following composition:

3–12 parts by weight of an anion-active plastic dispersion, calculated as dry weight 70–95 parts by weight of inorganic pigments 0.1–5 parts by weight of a water soluble slightly cation-active substance, calculated as solids; and up to 3 parts by weight of other auxiliary substances, such as, dispersion agents, defoaming agents, and thickening agents, wherein all parts by weight add up to 100 parts by weight.

There is a relationship between pH-value, solids content and the amount or type of a slightly cation-active substance. If, in a coating material, all other components remain unchanged regarding type and amount, the proportion of slightly cation-active substance can be decreased with the simultaneous and corresponding decrease in the pH-value. A reduction can also take place if the solids content of the coating material is increased. In the individual case, all components of the coating material are to be adjusted to each other. For coating materials with a 55–62 % solids content, a pH-value of 9–10 have proven to be especially suitable. Such compositions, in this case, have a flowability which does not differ from that of the usual coating materials.

The preparation of the coating material is not subject to any special limitations. However, it proves to be practical that, after the dispersion of the pigments in the alkaline range and addition of one or more plastic dispersions, to first add the cation-active substance and then to correct the pH-value.

The following examples illustrate the present invention.

Examples 1 to 5 present a composition of the coating material in accordance with the invention which is especially suitable for the preparation of light-weight paper, for roto-gravure printing.

Example 1 describes a coating material composition without added substances which become strongly cation-active at a pH of less than 6.5.

Examples 6–8 describe a coating material composition according to the invention which is preferred for the preparation of light-weight paper suitable for roll offset printing.

Example 2 describes a coating material composition without the added substances which become strongly cation-active at a pH below 6.5 .

Example 9 shows a typical example for the preparation of coated paper using the coating materials of examples 1–8 and of examples 1 and 2.

EXAMPLE 1

To an aqueous slurry of 10,444 parts by weight of China Clay prepared with the addition of a dispersing agent, and adjusted to a pH-value of 8.8 with sodium hydroxide solution, are mixed into 80 parts by weight of a 50% calcium stearate solution and 1,106 parts by weight of anion-active plastic dispersion based on a copolymer containing acrylic acid ester with a solids content of 50 weight %.

857 parts by weight of a 2.3% aqueous solution of a tertiary dimethyl-hexyl ammonium base are stirred into the mixture of pigment and plastic dispersion. The coating material is thinned to a solids content of 50 weight % and set to a pH-value of 8.7.

EXAMPLE 2

To a mixture of pigment and plastic dispersion corresponding to Example 1, 1,716 parts by weight of the solution of tertiary dimethyl-hexyl ammonium base used in Example 1 are added. The coating material is thinned to the solids content of 50% and adjusted to a pH-value of 8.4.

EXAMPLE 3

A coating material is prepared according to Example 1, wherein the solution used in Example 1 is replaced by 857 parts by weight of the 2.3% aqueous solution of a quaternary trimethyl-benzyl-ammonium compound. The coating material is adjusted to a solids content of 50 weight % and a pH-value of 8.6.

EXAMPLE 4

The coating material is prepared according to Example 1, wherein 1,287 parts by weight of the solution used in Example 3 are added. The coating material is adjusted to a solids content of 50 weight % and a pH-value of 8.6.

EXAMPLE 5

A coating material is prepared according to Example 4, its solids content is adjusted to 46 weight % and the pH-value is 8.2.

COMPARISON EXAMPLE 1

A coating material is prepared according to Example 1 and adjusted to a solids content of 50% and a pH-value of 8.5. But compared to Examples 1 to 5, a solution of cation-active substance is not added to this coating material.

EXAMPLE 6

By adding 9 parts by weight of a dispersing agent, 20 parts by weight of 33% sodium hydroxide solution and 15 parts by weight of sodium carbonate, an aqueous reduction to paste of 9,300 parts by weight of China Clay is produced.

A solution is produced by admixing 800 parts by weight of water and 200 parts by weight of casein, 19 parts by weight of 33% sodium hydroxide solution, and 12 parts by weight of 25% ammonia. This solution is added to the reduction to paste of the pigments.

1,440 parts by weight of an anionic plastic dispersion based on acrylic acid ester and styrene copolymer with a solids content of 50 weight % and 600 parts by weight of anionic plastic dispersion based on polyvinyl acetate copolymer with a solids content of 45 weight % are admixed sequentially with the mixture of pigment and casein.

Finally 1,515 parts by weight of the 12.5% solution of a trimethyl-benzyl ammonium compound are mixed in and the coating material is adjusted to a solids content of 50% and a pH-value of 8.4.

EXAMPLE 7

A coating material is prepared according to Example 6, but instead of the solution added in Example 6, 1,516 parts by weight of a 15.1% solution of the same substance as in Example 6 are added. The coating material is set to a solids content of 50% and a pH-value of 8.2.

EXAMPLE 8

A coating material is prepared according to Example 6, but instead of the solution added in Example 6, 1,312 parts by weight of a 12.5% solution of the same substance as in Example 6 are added. The coating material is adjusted to a solids content of 60% and a pH-value of 9.6.

COMPARISON EXAMPLE 2

A coating material is prepared according to the formulas of Examples 6 to 8, but a solution of a cation-active substance is not added. The coating material is adjusted to a pH-value of 10 and a solids content of 50%.

EXAMPLE 9

In a coating test unit with a machine speed of 85 m/min. with a blade coating device, coating materials according to Examples 1 to 4, 6 to 8, and comparison Examples 1 and 2 are applied on a light-weight, ground wood-containing raw paper for coating with a weight per unit area of 39 g/m$^2$ and a surface pH of 4.8 on one side, and the paper is dried as usual. The weight of the dried coating is 11 g/m$^2$.

Under the same test conditions at the test coating device, a coating material according to Example 5 is applied and dried on a ground wood-containing raw paper with a weight per unit area of 35 g/m$^2$ and a surface pH-value of 4.6, wherein the weight of the dried coating is 6.5 g/m$^2$ per side.

In coating materials according to Examples 1–8 during a two-hour test, no penetration of the coating material was observed, while with coating materials according to Comparison Examples 1 and 2, penetration of the coating material and deposits on the coating cylinder occurred.

In order to enable an exact evaluation and classification of the penetration behavior of the coating materials described according to Examples 1 to 8 and the Comparison Examples 1 and 2, a new testing method and a testing device suitable for this method were developed and the individual coating materials were examined. Substrates suitable as carriers for the coating were loaded under shearing action and pressure with the coating materials, and the penetration behavior was made visible. The testing device used is shown in FIGS. 1–3.

FIG. 1 illustrates the principle clear of the test. A dye pool 17 is made of the coating material to be examined. Due to the pressure of the pressing cylinders 4,5, the coating material is pressed through the test paper web 12, and in this way, produces on contrast material 16, more or less strong markings. The larger and more numerous these markings are, the more the coating material is inclined to penetrate. As a contrast material, a paper having a color different from the coating material can be used.

Figure 2:
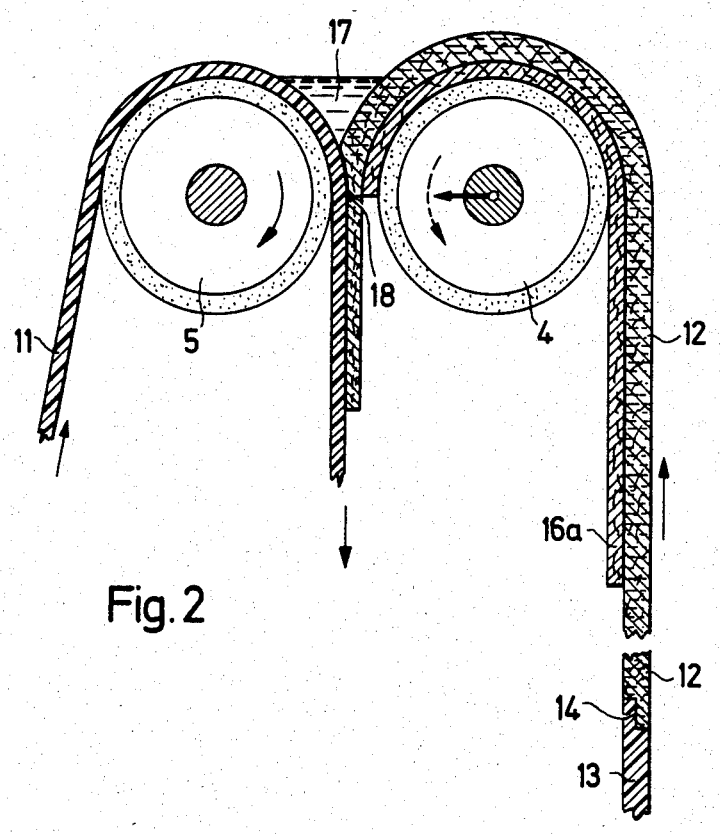
Figure 3:
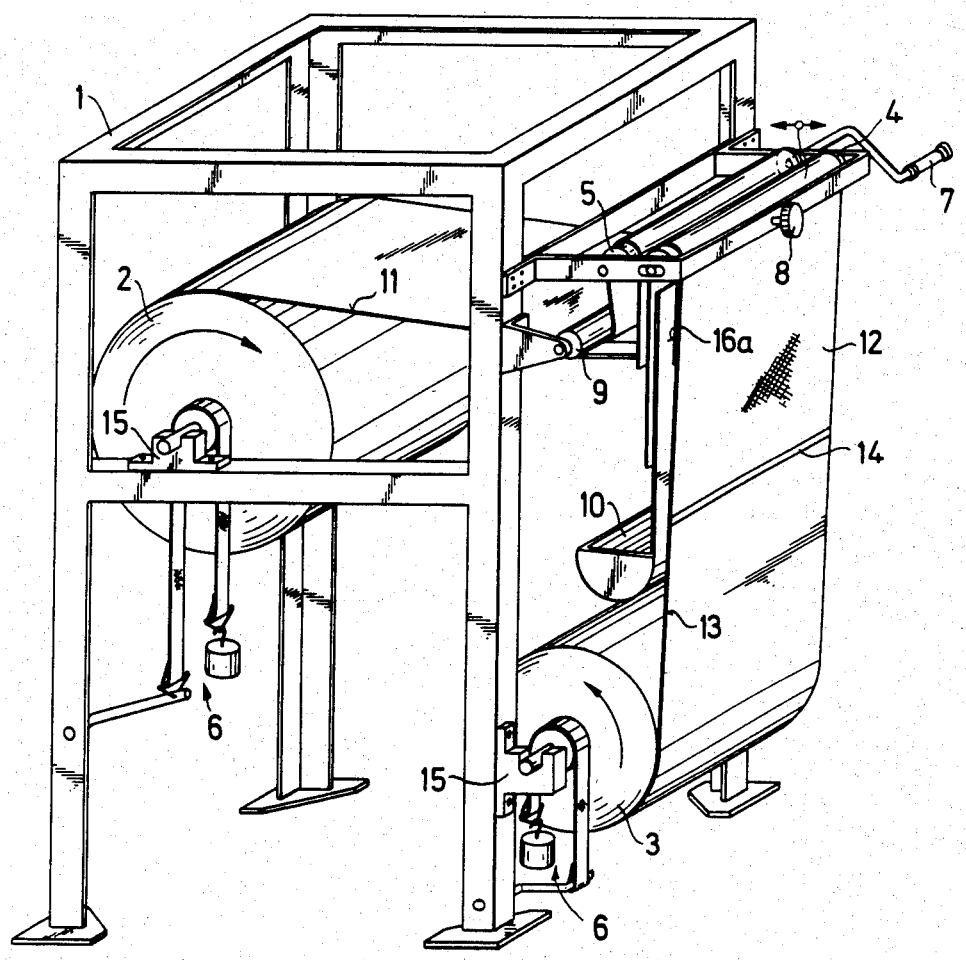
FIG. 3 shows a total view of the device as a perspective drawing.

An improved, and in this case, applied testing method can be seen in FIGS. 2 and 3. Here, the pressing cylinder 5 is covered with a following foil sheet 11 made of polyethylene. The foil sheet prevents adhesion of the test paper web 12 to the pressing cylinder 5. An LWC raw paper of 38 g/m$^2$ is used as a test paper web.

On the test paper web 12, an initial marking 18 is applied, which is directly before the contact line of the two pressing cylinders 4,5 and above the start of the contrast material 16*a*. As contrast material 16*a*, black paper is used which, at its beginning, is glued onto the pressing cylinder 4.

The length of the contrast material 16*a* corresponds to the circumference of the pressing cylinder 4. The length of the test paper web 12 is chosen in such a way that it corresponds to six times the circumference of the pressing cylinder 4, and consequently six times to the length of the contrast material 16*a*. By this means, the markings appear on the contrast paper in a sixfold multiple.

The end of the test paper web 17 is connected with a foil sheet made of polyethylene, which cannot be penetrated by the coating material, by means of a glued seam 14, which represents at the same time the end marking. In this way, it is possible to lead the test paper web up to behind the end of the glued seam 14 without the appearance of more markings than correspond to the measured test length on the contrast material. The width of the contrast material 16*a* is 3 cm less than the width of the pressing cylinders 4,5.

In order to achieve perfect web guidance, the foil sheet 11 and the impermeable sheet 13 are unrolled from the feed rolls 2 and 3. The feed rolls 2 and 3 are supported on bearing brackets 15 installed on a rack 1, and are slowed down by a band brake 6. The width of the foil sheet 11 corresponds to the width of the contrast material 16*a*. Below the pressing cylinder 5, a guide roll 9 is installed for guidance of the foil sheet 11. To receive the dripping coating material below pressing cylinders 4,5, a container 10 is provided. Drive of the pressing cylinders 4,5 takes place by means of a crank handle 7 on the rigidly supported pressing cylinder 5. The pressing cylinder 4 can be pressed against the pressing cylinder 5, wherein the contact pressure can be adjusted by means of a control button 8 and can be read on a dial that is not shown. The pressing cylinder 4 is driven by means of a pair of gear wheels, not shown here, from the pressing cylinder 5.

Performance and Evaluation of Tests

After cylinder 4 is covered with contrast paper as described, the test paper web 12, connected with the material 13 and the foil sheet 11 are fed in, and the pressing cylinders 4,5 are pressed together. Subsequently, a dye pool 17 is formed from the coating material. By activating the crank handle 7, the test paper web 12 is led through the dye pool in the measured length. Subsequently, the contrast material 16*a* is removed and compared with an evaluation dial, which consists of eight different stages of penetration.

Stage 1 characterizes a very limited penetration behavior and stage 8 a very heavy penetration behavior.

The evaluation of the coating materials described in the examples resulted in the values shown in the Table:

| | Examples | | | | | | | | Comparison Examples | |
|---|---|---|---|---|---|---|---|---|---|---|
| | 1 | 2 | 3 | 4 | 5 | 6 | 7 | 8 | 1 | 2 |
| Penetration Behavior: | 5 | 3 | 2 | 1 | 2–3 | 5 | 2 | 1–2 | 6 | 6 |

The results of these tests is further supported if samples of the finished paper are examined with the Heliotest process. The Heliotest process is a process that is generally used in the paper and printing industry and was developed by the Centre Technique de l'Industrie des Papiers, Cartons et Celluloses; Grenoble, France.

The Heliotest is used for the numerical determination of missing dots. Compared to the coating processes used to date, a reduction in missing parts between 30 and 40% results with the process of the present invention.

What is claimed is:

1. A process for preparing a coating paper substrate consisting essentially of preparing a raw paper substrate having a pH of less than about 6.5, applying a coating thereto composed of an aqueous dispersion of a plastic and inorganic pigments, the coating having a pH of more than about 6.5 wherein the particles of the plastic in the dispersion have a non-cation-active charge and wherein the coating also contains a material which does not affect the preparation or storage stability of the coating, but which in the pH-range below about 6.5 becomes highly cation-active resulting in solidification of the coating at the time of contact of the coating with the paper surface to minimize penetration of the coating into the paper, and then drying the thus applied coating.

2. The process of claim 1, wherein the paper substrate has a pH-value between 4.5 and 6.0.

3. The process of claims 1 or 2, wherein the pH-value of the substrate is adjusted to 4.50 to 6.0 by adding a sulfuric acid compound of aluminum to the substrate preparation.

4. The process of claims 1 or 2, wherein the pH-value of the substrate is adjusted by adding sulfuric acid.

5. The process of claims 1 or 2, wherein a coating material is used with a pH-value between 7.5 and 11.

6. The process of claims 1 or 2, wherein a coating material is used which contains a plastic dispersion whose particles carry an anion-active charge.

7. The process of claims 1 or 2, wherein a coating material is used which contains a plastic dispersion whose particles carry an anion-active charge, and wherein the anion-active charge of the plastic dispersion is caused by anionic groups of the plastic molecule.

8. The process of claims 1 or 2, wherein a coating material is used which contains a plastic dispersion whose particles carry an anion-active charge, and wherein the anion-active charge of the plastic dispersion is caused by stabilizers or emulsifiers.

9. The process of claims 1 or 2, wherein a coating material is used in which the substance which becomes strongly cation-active in the pH-range below 6.5 is slightly cation-active.

10. The process of claims 1 or 2, wherein a coating material is used in which the substance which becomes strongly cation-active in the pH-range below 6.5 is slightly cation-active, and consists of one or more compounds which are soluble in water and selected from the group consisting of tertiary and quaternary amino-compounds.

11. The process of claims 1 or 2, wherein a coating material is used in which the substance which becomes strongly cation-active in a pH-range below 6.5 is present in such amounts that the stability of the coating material above a pH-value of 6.5 is not affected.

12. The process of claims 1 or 2, wherein a coating material is used in which the substance which becomes strongly cation-active in the pH-range below 6.5 is slightly cation-active, and wherein the slightly cation-active substance is contained in an amount of 2 to 20 parts by weight of solids, relative to 100 parts by weight of dry substance of the plastic dispersion.

13. The process of claims 1 or 2, wherein a coating material with a solids content of 30 to 35 weight percent is applied, and subsequently dried, with an airknife coating device on one side of a raw paper or cardboard for coating in such an amount that the weight of the dried coating is 10 to 12 $g/m^2$.

14. A process for preparing a coated paper substrate consisting essentially of preparing a raw paper substrate having a pH of less than about 6.5, applying a coating thereto composed of an aqueous dispersion of a plastic and inorganic pigments, the coating having a pH of more than about 6.5 wherein the particles of the plastic in the dispersion have a non-cation-active charge and wherein the coating also contains a material which does not affect the preparation or storage stability of the coating, but which in the pH-range below about 6.5 becomes highly cation-active resulting in solidification of the coating at the time of contact of the coating with the paper surface to minimize penetration of the coating into the paper, and then drying the thus applied coating, said coating having a solids content of 45 to 67 weight percent, and being applied on both sides of a ground wood-containing raw paper having a weight per unit area of 32 to 38 $g/m^2$, with a blade coating device and wherein after drying, the weight of the dried coating is between 6 to 7 $g/m^2$ per side.

15. The process of claim 14, wherein a ground wood containing raw paper with a weight per unit area of 34 to 36 $g/m^2$ is used.

* * * * *